US008453420B2

(12) United States Patent
Schmidt et al.

(10) Patent No.: US 8,453,420 B2
(45) Date of Patent: Jun. 4, 2013

(54) FILM DISPENSING AND WRAPPING APPARATUS OR SYSTEM USING SMART TECHNOLOGY

(75) Inventors: Daniel Schmidt, Arlington Heights, IL (US); Robert Jacob, Arlington Heights, IL (US); Thomas Mutch, Le Sueur, MN (US); Petar Isaev, St. Leonard (CA); Stephen G. Forrest, Quebec (CA)

(73) Assignee: Illinois Tool Works Inc., Glenview, IL (US)

( * ) Notice: Subject to any disclaimer, the term of this patent is extended or adjusted under 35 U.S.C. 154(b) by 317 days.

(21) Appl. No.: 12/659,714

(22) Filed: Mar. 18, 2010

(65) Prior Publication Data

US 2010/0300049 A1 Dec. 2, 2010

Related U.S. Application Data

(60) Provisional application No. 61/213,318, filed on May 29, 2009.

(51) Int. Cl.
*B65B 53/00* (2006.01)

(52) U.S. Cl.
USPC ..... 53/441; 53/556

(58) Field of Classification Search
USPC ..... 53/441, 556, 389.2, 587, 399
See application file for complete search history.

(56) References Cited

U.S. PATENT DOCUMENTS

| | | | | | |
|---|---|---|---|---|---|
| 4,458,467 | A * | 7/1984 | Shulman et al. | 53/399 |
| 5,311,725 | A * | 5/1994 | Martin et al. | 53/556 |
| 5,423,163 | A * | 6/1995 | Wendt | 53/556 |
| 5,517,807 | A * | 5/1996 | Morantz | 53/556 |
| 5,606,849 | A * | 3/1997 | Bettenhausen | 53/556 |
| 5,628,167 | A * | 5/1997 | Huson et al. | 53/465 |
| 5,794,418 | A * | 8/1998 | Lai | 53/556 |
| 5,836,140 | A * | 11/1998 | Lancaster, III | 53/399 |
| 6,360,512 | B1 * | 3/2002 | Marois et al. | 53/399 |
| 6,874,297 | B2 * | 4/2005 | Solis et al. | 53/399 |
| 7,707,802 | B2 * | 5/2010 | Forrest | 53/399 |
| 8,001,745 | B2 * | 8/2011 | Carter et al. | 53/64 |

FOREIGN PATENT DOCUMENTS

| | | |
|---|---|---|
| EP | 1188671 | 3/2002 |
| EP | 1213223 | 6/2002 |
| WO | 2007010341 | 1/2007 |
| WO | 2008115865 | 9/2008 |

* cited by examiner

*Primary Examiner* — Sameh H. Tawfik
(74) *Attorney, Agent, or Firm* — Law Offices of Steven W. Weinrieb

(57) ABSTRACT

A film wrapping machine or apparatus wherein various operational conditions and data can be detected, determined, and subsequently utilized for diagnostic, operational performance, and safety characteristics, as well as for implementing improvements in operational performance so as to not only achieve optimal or predetermined performance characteristics but to also achieve economical usage of the wrapping or packaging film.

14 Claims, 5 Drawing Sheets

FILM DISPENSING AND WRAPPING APPARATUS OR SYSTEM USING SMART TECHNOLOGY

CROSS REFERENCE TO RELATED PATENT APPLICATIONS

This patent application is related to, and based upon, U.S. Provisional Patent Application Ser. No. 61/213,318 which was filed on May 29, 2009, the priority benefits of which are hereby claimed.

FIELD OF THE INVENTION

The present invention relates generally to film wrapping machines or apparatus, and more particularly to a film wrapping machine or apparatus wherein various operational conditions and data can be detected, determined, and subsequently utilized for diagnostic, operational performance, and safety characteristics, as well as for implementing improvements in operational performance so as to not only achieve optimal or predetermined performance characteristics but to also achieve economical usage of the wrapping or packaging film.

BACKGROUND OF THE INVENTION

Film dispensing and wrapping or packaging machines or apparatus, for wrapping articles, packages, or palletized loads within wrapping or packaging film, are of course well known in the art. Examples of such film dispensing and wrapping or packaging machines or apparatus are disclosed within U.S. Pat. No. 6,195,961 which issued to Turfan on Mar. 6, 2001, U.S. Pat. No. 5,787,691 which issued to Turfan on Aug. 4, 1998, U.S. Pat. No. 5,517,807 which issued to Morantz on May 21, 1996, and U.S. Pat. No. 4,587,796 which issued to Haloila on May 13, 1986. In addition, or in conjunction with the aforenoted patented disclosures, it is known that there are several different types of conventional film dispensing and wrapping or packaging machines. Briefly, for example, a turntable type film dispensing and wrapping or packaging machine is disclosed within FIG. 1 and is generally indicated by the reference character 100. In accordance with such a turntable type film dispensing and wrapping or packaging machine 100, a palletized load, not shown, is adapted to be placed upon a turntable 102, and a wrapping or packaging film dispensing carriage assembly 104 is movably mounted in a vertically reciprocable manner upon an upstanding standard or support mast 106. Accordingly, as the palletized load is rotated around the rotary axis of the turntable 102, and as the wrapping or packaging film dispensing carriage assembly 104 is moved in a vertically reciprocable manner, either from its uppermost position to its lowermost position, or from its lowermost position to its uppermost position, the wrapping or packaging film, dispensed from the wrapping or packaging film dispensing carriage assembly 104, wraps or packages the palletized load within the wrapping or packaging film.

Continuing further, a rotary arm type film wrapping or packaging machine is disclosed within FIG. 2 and is generally indicated by the reference character 200. In accordance with such a rotary arm type film dispensing and wrapping or packaging machine 200, an upstanding framework 202 effectively defines a film wrapping or packaging station 204 at an axially central portion thereof, and a palletized load, not shown, which is to be wrapped or packaged within film wrapping or packaging material, is adapted to be disposed at such film wrapping or packaging station 204. A rotary arm assembly 206, which is rotatably mounted upon an upper frame member 208 of the upstanding framework 202, is adapted to rotate around the film wrapping or packaging station 204, and a wrapping or packaging film dispensing carriage assembly 210 is movably mounted in a vertically reciprocable manner upon the rotary arm assembly 206. Accordingly, as the rotary arm assembly 206 is rotated around the film wrapping or packaging station 204, and as the wrapping or packaging film dispensing carriage assembly 210 is moved in a vertically reciprocable manner, either from its uppermost position to its lowermost position, or from its lowermost position to its uppermost position, the wrapping or packaging film, dispensed from the wrapping or packaging film dispensing carriage assembly 210, wraps or packages the palletized load within the wrapping or packaging film.

Lastly, a rotary ring type film wrapping or packaging machine is disclosed within FIG. 3 and is generally indicated by the reference character 300. In accordance with such a rotary ring type film dispensing and wrapping or packaging machine 300, an upstanding framework 302 effectively defines a film wrapping or packaging station 304 at an axially central portion thereof, and a palletized load, not shown, which is to be wrapped or packaged within film wrapping or packaging material, is adapted to be disposed at such film wrapping or packaging station 304. A rotary ring member 306 is rotatably mounted upon a frame member 308 so as to rotate around the film wrapping or packaging station 304, and the frame member 308 is adapted to be movably mounted in a vertically reciprocable manner upon the upstanding framework 302. In addition, a wrapping or packaging film dispensing carriage assembly, not shown, is adapted to be fixedly mounted upon the rotary ring member 306. Accordingly, as the rotary ring member 306 is rotated around the film wrapping or packaging station 304, and as the frame member 308 is moved in a vertically reciprocable manner, either from its uppermost position to its lowermost position, or from its lowermost position to its uppermost position, the wrapping or packaging film, dispensed from the wrapping or packaging film dispensing carriage assembly, wraps or packages the palletized load within the wrapping or packaging film.

Regardless of which type of conventional film wrapping or packaging machine is utilized to wrap or package palletized loads within wrapping or packaging film, one desirable operative objective of a film wrapping or packaging operation or procedure is to be able to determine, for example, how much force or tension is being impressed upon the wrapping film, and in conjunction with such, it is desirable to effectively confirm that the force or tension which the wrapping film is actually experiencing corresponds to the desired film force or tension predeterminedly inputted into the apparatus as an operative output characteristic. Another operative objective which one may want to know or monitor in connection with film wrapping apparatus is how much pre-stretch is being impressed upon the wrapping film so as to in fact be capable of achieving a predetermined amount of pre-stretch within the wrapping film. Still another operative objective which one may want to know or monitor, in connection with film wrapping apparatus, is how much wrapping film is in fact being used, for example, per wrapped load, or the number of loads that can be wrapped per roll of wrapping film. Ultimately, the capability of monitoring and knowing the aforenoted operative features or characteristics can lead to the optimal operation of the film wrapping apparatus or system. Still yet further, it is also desirable to incorporate within film wrapping apparatus or systems various operational maintenance or safety mechanisms which can effectively inform operator personnel that, for example, the amount of wrapping film remaining upon a particular roll of wrapping film mounted upon the wrapping or packaging film dispensing carriage assembly is running low, that the door, covering the film drive rollers and normally disposed in a CLOSED and LOCKED position for the protection of operator personnel, is actually OPEN and therefore the apparatus could be operating in an unsafe mode, or that the mandrel or spindle, upon which the roll of wrapping film is disposed, is disposed at an OPEN or LOADING position which would also effectively place the apparatus in an unsafe operating mode. No prior art of which applicants are aware provide all of the various aforenoted operative features or characteristics.

A need therefore exists in the art for a new and improved film dispensing and wrapping system or apparatus wherein the various aforenoted operative features or characteristics are able to be determined, monitored, and controlled so as to achieve optimal film wrapping operations to be performed by means of the film dispensing and wrapping systems or apparatus, and to ensure that the system or apparatus is in fact being operated in a safe mode of operation for the protection of operator personnel.

SUMMARY OF THE INVENTION

The foregoing and other objectives are achieved in accordance with the teachings and principles of the present invention through the provision of a new and improved film dispensing and wrapping system or apparatus wherein a wrapping or packaging film dispensing carriage assembly is provided with a pair of drive rollers which are driven at different speeds by means of a drive motor and a belt-and-pulley drive system so as to impart a predetermined amount of pre-stretch to the wrapping or packaging film. An infeed target roller and an infeed pinch roller are operatively associated with the pair of drive rollers and are provided upon the infeed side of the pair of drive rollers, and an outfeed target roller and an outfeed pinch roller are also operatively associated with the pair of drive rollers and are provided upon the outfeed side of the pair of drive rollers. Both the infeed and outfeed target rollers have sensor targets mounted thereon, and first and second proximity sensors are respectively disposed adjacent to the target rollers so as to in fact detect the presence of the sensor targets as the target rollers rotate at speeds proportional to the film speed. The film speed at the first or infeed target roller is different from the film speed at the second or outfeed target roller, and this difference in speeds comprises the amount of pre-stretch imparted to the film. The proximity sensors will generate pulse signals each time it detects one of the sensor targets each time, for example, the particular target roller completes a revolution, and these pulse signals will be transmitted to a first programmable logic controller (PLC), located upon the wrapping or packaging film dispensing carriage assembly, such that the first programmable logic controller (PLC) can then calculate the amount of pre-stretch actually being imparted to the wrapping or packaging film, as well as the amount of wrapping or packaging film actually being used for each wrapped load, or still further, for example, how many loads can in fact be wrapped or packaged using a single roll of film. All of the aforenoted data signals from the target roller proximity sensors, indicative of the film speeds and the amount of film usage, are, in turn, transmitted from the first programmable logic controller (PLC), located upon the wrapping or packaging film dispensing carriage assembly, to a second programmable logic controller (PLC), which is located within a remotely-located operator console, by means of first and second wireless transmission modules or transceivers. Accordingly, the operator can monitor such data and make any changes to the apparatus or system components as may be deemed necessary.

A tension roller, which has incorporated therein a suitable strain gauge or load cell, is operatively associated with the pair of drive rollers so as to measure the tension being imparted to the wrapping or packaging film. The strain gauge or load cell will transmit appropriate sensed signals, indicative of the tension levels being imparted to the wrapping or packaging film, directly to a second programmable logic controller (PLC), located upon the remotely-located operator console or the like, such that the second programmable logic controller (PLC) can in fact calculate or determine the actual tension being imparted to the wrapping or packaging film. Still further, the overall film dispensing and wrapping system or apparatus of the present invention is also provided with several additional operational and safety features. For example, a photoeye is incorporated within the framework of the film dispensing and wrapping system or apparatus so as to monitor the amount of film remaining upon the roll of film mounted upon the film roll mounting spindle or mandrel. The photoeye is radially offset a predetermined amount with respect to, for example, an external peripheral portion of the mandrel or spindle, such that when the film, disposed upon the film roll, is depleted to such an extent that the diametrical extent of the film disposed upon the film roll is no longer captured by means of the photoeye, the photoeye will generate a signal indicating a low film level. This signal is also transmitted directly to the second programmable logic controller (PLC) whereby an operator, disposed at the operator console, can initiate the necessary operations to replace the depleted roll of wrapping or packaging film with a new or fresh roll of wrapping or packaging film.

Continuing still further, the spindle or mandrel, upon which the roll of wrapping or packaging film is mounted, is pivotally movable from its normal, vertically upstanding operative position to a tilted or inclined LOAD/UNLOAD position at which the mandrel or spindle is disposed so as to facilitate the unloading of a depleted roll of film from the spindle or mandrel, and the mounting of a new or fresh roll of film onto the mandrel or spindle. Alternatively, after, for example, a new or fresh roll of film has been mounted upon the mandrel or spindle, the mandrel or spindle is pivotally moved back to its normal, vertically upstanding operative position such that the apparatus or system can now be employed to wrap or package a load within the wrapping or packaging film. The mandrel or spindle is also mounted upon a pivotal framework which includes a finger, and the finger operatively cooperates with a limit switch mounted upon the framework of the wrapping or packaging film dispensing carriage assembly so as to generate a signal when the mandrel or spindle framework has in fact been moved back to its normal, vertically upstanding operative position. This signal is also transmitted directly to the second programmable logic controller (PLC) located upon the operator console. Accordingly, if such a signal is not generated by the limit switch, indicating that the mandrel or spindle has not in fact been completely moved back to its normal, vertically upstanding operative position, the second programmable logic controller (PLC) will not initiate operation of the film dispensing and wrapping system or apparatus.

Still yet further, it is also noted that another safety feature incorporated within the new and improved film dispensing and wrapping system or apparatus of the present invention resides in the provision of a third proximity sensor in conjunction with the door that is normally disposed at its CLOSED position with respect to the first and second drive rollers in order to protect operator personnel from any injuries involving the first and second drive rollers. More particularly, the door normally covering the first and second drive rollers is provided with a locking mechanism which includes, for example, a dead-bolt type locking member. Accordingly, when the locking mechanism is moved to its LOCKED position at which, for example, the dead-bolt locking member is moved to its EXTENDED position, this EXTENDED position of the dead-bolt locking member will be detected by means of this third proximity sensor. The third proximity sensor will generate a signal and transmit the same to the first programmable logic controller (PLC) which will permit operation of the film dispensing and wrapping system or apparatus to be initiated. If the first programmable logic controller (PLC) does not receive such a signal from the third proximity sensor, operation of the film dispensing and wrapping system or apparatus will be prevented.

Lastly, at least one human-machine-interface (HMI) is provided upon the remotely-located operator console. The human-machine interface (HMI) may comprise various different formats or structures, such as, for example, a keyboard, a keypad, numerous USB ports, a screen monitor, or the like, by means of which operator personnel can effectively interface with, for example, the second programmable logic controller (PLC), and therefore, through means of the first and second wireless transmission modules or transceivers, with the first programmable logic controller (PLC) so as to in fact control the various power structures of the wrapping or packaging film dispensing carriage assembly. It is also to be noted that as a result of the provision of the human-machine-interface (HMI), which may, as noted, comprise, for example, one or more USB ports, operator personnel can effectively plug in a telephone, laptop computer, notebook, notepad, or the like, whereby all of the data stored, for example, within the second programmable logic controller (PLC), can be downloaded and transmitted to remote data storage servers or the like for usage at a later time. Control commands from the operator's laptop computer, notebook, notepad, or the like, can likewise be inputted back into the second programmable logic controller (PLC) for transmission back to the first programmable logic controller (PLC) so as to, for example, alter the various power drive signals for the various power-driven structures of the wrapping or packaging film dispensing carriage assembly so as to in fact achieve optimal output performance levels.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
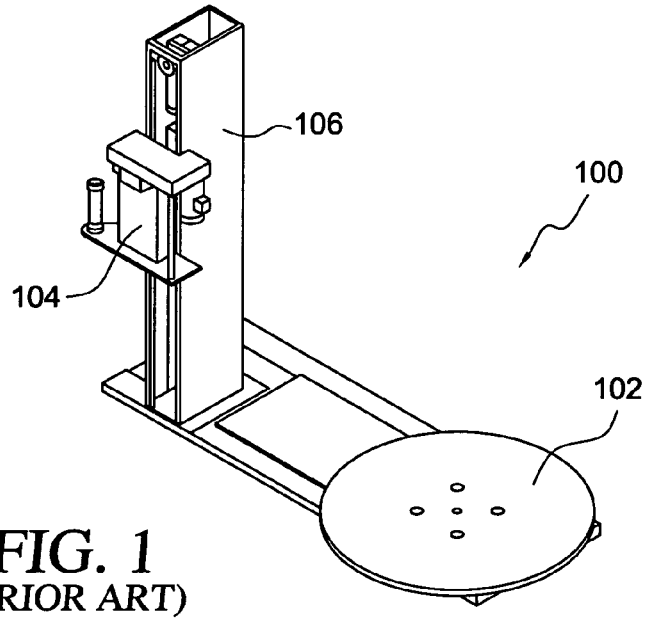
FIG. 1 (PRIOR ART)
FIG. 1 is a perspective view of a first conventional, PRIOR ART turntable type film wrapping or packaging machine.
Figure 2:
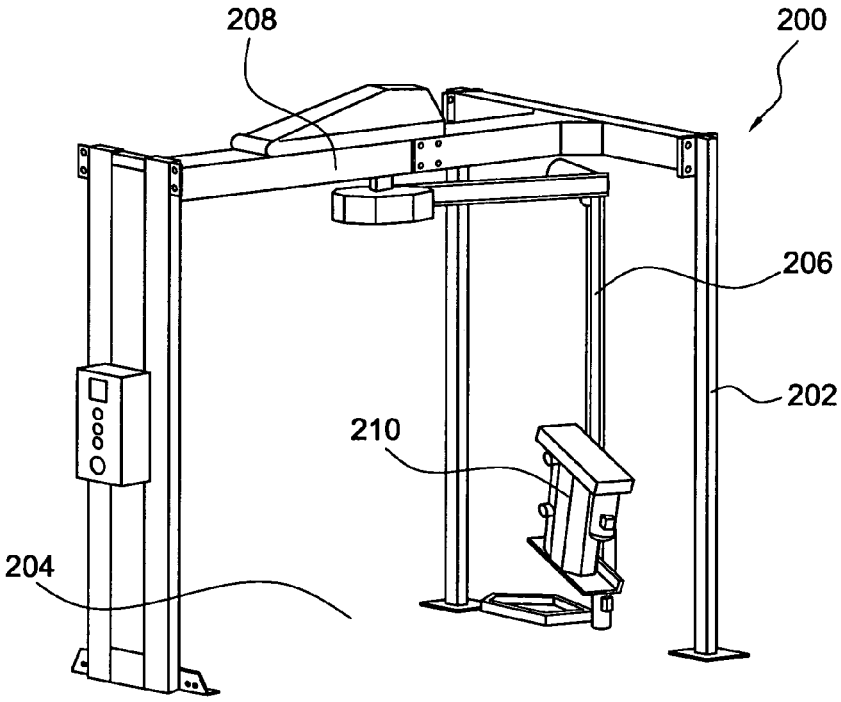
FIG. 2 (PRIOR ART)
FIG. 2 is a perspective view of a second conventional, PRIOR ART rotary arm type film wrapping or packaging machine.
Figure 3:
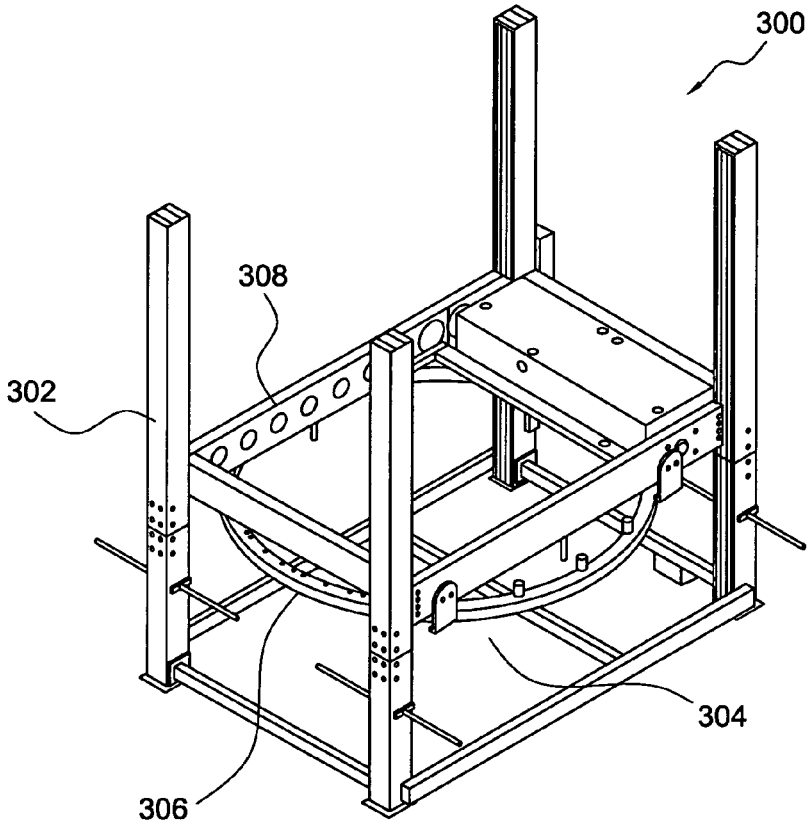
FIG. 3 (PRIOR ART)
FIG. 3 is a perspective view of a third conventional, PRIOR ART rotary ring type film wrapping or packaging machine.
Figure 4:
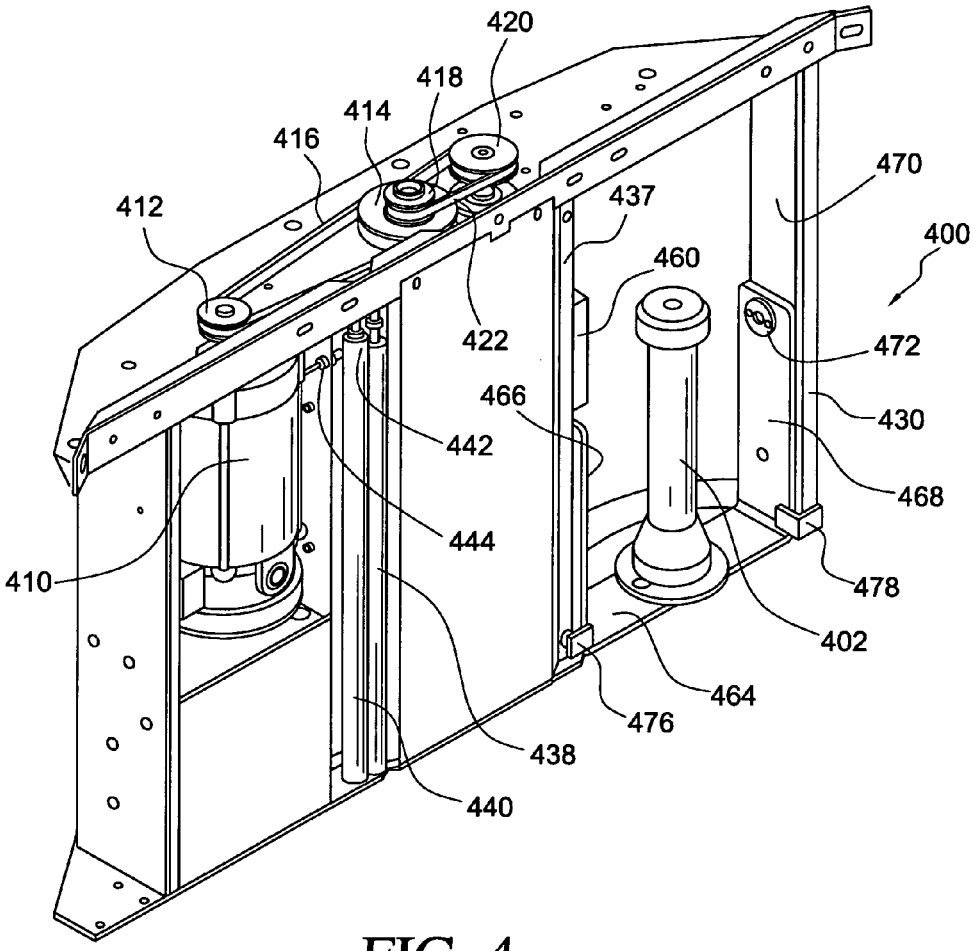
FIG. 4 is a perspective view of a wrapping or packaging film dispensing carriage assembly, as observed from the side of the wrapping or packaging film dispensing carriage assembly which faces the palletized load, as constructed in accordance with the principles and teachings of the present invention.
Figure 5:
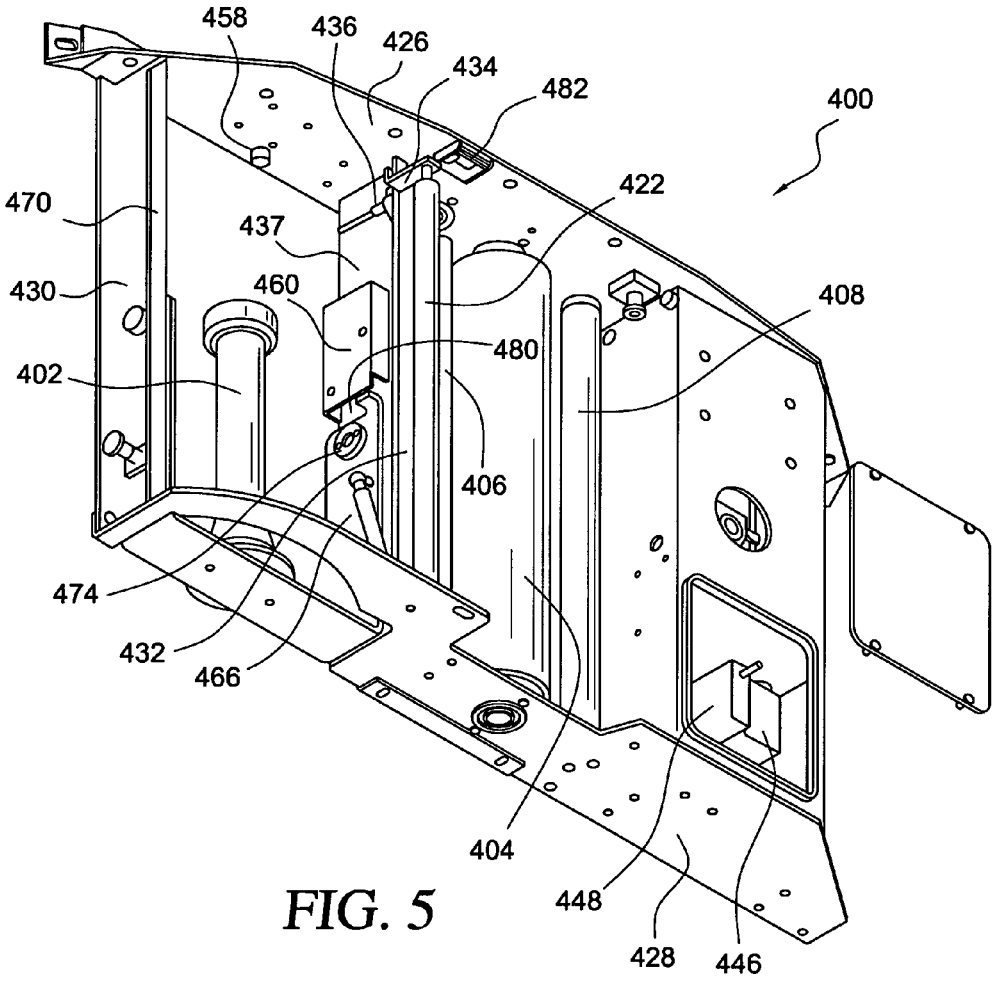
FIG. 5 is a perspective view of the wrapping or packaging film dispensing carriage assembly as disclosed in FIG. 4 and as observed from the side of the wrapping or packaging film dispensing carriage assembly which faces away from the palletized load.
Figure 6:
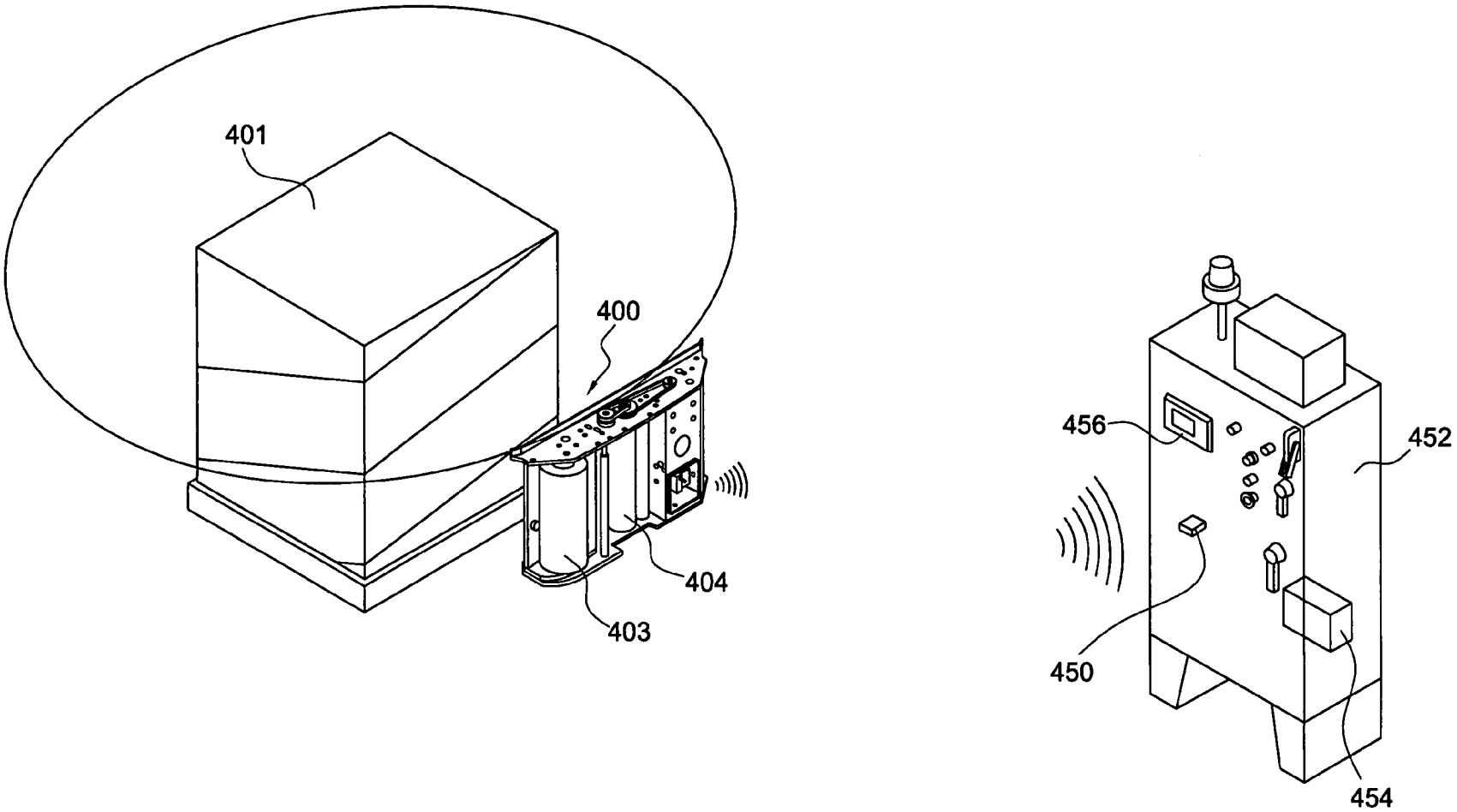
FIG. 6 is a schematic perspective view of the wrapping or packaging film dispensing carriage assembly as disclosed in FIG. 4 wherein the wrapping or packaging film dispensing carriage assembly is effectively disclosed as being relatively movable around a palletized load disposed at a package wrapping station, and wherein further, the wrapping or packaging film dispensing carriage assembly is disposed in communication with, for example, a programmable logic controller (PLC) disposed within a control cabinet.

Referring now to the drawings, and more particularly to FIGS. 4 and 5 thereof, a wrapping or packaging film dispensing carriage assembly, which has been developed in accordance with the principles and teachings of the present invention and which may be used as a wrapping or packaging film dispensing carriage assembly upon any one of the film wrapping or packaging machines, systems, or apparatus as disclosed within FIG. 1-3, is illustrated and is generally indicated by the reference character 400. The wrapping or packaging film dispensing carriage assembly 400 is adapted to be angularly moved in a rotating fashion relative or with respect to, for example, a palletized load 401 disposed at a wrapping or packaging station as schematically illustrated within FIG. 6. More particularly, it is seen, for example, that the wrapping or packaging film dispensing carriage assembly 400 is seen to comprise an upstanding spindle or mandrel 402 upon which a roll of wrapping or packaging film, illustrated at 403 within FIG. 6, is adapted to be mounted, and that, for example, first and second pre-stretch drive rollers 404,406, and a suitable tension roller 408, which contains a strain gauge or load cell, not shown, are adapted to be mounted upon the wrapping or packaging film dispensing carriage assembly 400. More particularly, still further, in order to drive the first and second drive rollers 404,406, it is seen that a drive motor 410 is mounted upon the wrapping or packaging film dispensing carriage assembly 400 at a position remote from the film roll mounting mandrel or spindle 402, and that a first drive pulley 412 is operatively connected to the output drive shaft of the drive motor 410. A first driven pulley 414 is disposed atop, and is operatively connected to, the upper end portion of the roller shaft upon which the first pie-stretch drive roller 404 is mounted, and it is seen that the first drive pulley 412 and the first driven pulley 414 are drivingly interconnected by means of a first drive belt 416. A second driven pulley 418 is coaxially mounted atop the first driven pulley 414, while a third driven pulley 420 is disposed atop, and is operatively connected to, the upper end portion of the roller shaft upon which the second pre-stretch drive roller 406 is mounted. A second drive belt 422 operatively interconnects the second and third driven pulleys 418,420, and it is of course to be appreciated that the relative rotary speeds defined, or existing, between the first and second pre-stretch rollers 404,406 will in fact determine the amount of pre-stretch imparted to the wrapping or packaging film. Accordingly, it can be appreciated still further that the amount or percentage of pre-stretch imparted to the wrapping or packaging film may be predeterminedly defined or changed by predeterminedly matching particularly sized drive and driven pulleys 414,418,420 so as to in fact achieve predetermined rotary speed ratios between the first and second drive rollers 404,406, wherein such differential speed ratios between the first and second drive rollers 404, 406 define or determine the aforenoted amount of pre-stretch imparted to the wrapping or packaging film.

Continuing still further, and as can best be seen from FIG. 5, an infeed idler pinch roller 424 is rotatably mounted upon the wrapping or packaging film dispensing carriage assembly 400 such that oppositely disposed upper and lower end portions of the infeed idler pinch roller 424 extend between upper and lower members 426,428 of the wrapping or packaging film dispensing carriage assembly framework 430, while an infeed idler target roller 432 is rotatably mounted in a similar manner upon the wrapping or packaging film dispensing carriage assembly 400 such that oppositely disposed upper and lower end portions of the infeed idler target roller 432 extend between the upper and lower members 426,428 of the wrapping or packaging film dispensing carriage assembly framework 430. It will thus be appreciated that the infeed idler pinch roller 424 and the infeed idler target roller 432 are both located upstream of the first and second drive rollers 404,406 as considered in the direction of the feeding or the dispensing of the wrapping or packaging film from the roll of wrapping or packaging film disposed upon the upstanding spindle or mandrel 402. The upper end portion of the infeed idler target roller 432 is provided with a sensor target 434, which may simply be the head portion of a fastener screw threadedly engaged within the external peripheral wall portion of the infeed idler target roller 432, and a first proximity sensor 436 is mounted upon a wall member 437 of the wrapping or packaging film dispensing carriage assembly framework 430 so as to be capable of detecting or sensing the presence of the infeed idler target roller sensor target 434 each time the infeed idler target roller 432 completes one revolution.

In a similar manner, as can best be seen from FIG. 4, an outfeed idler pinch roller 438 is also rotatably mounted upon the wrapping or packaging film dispensing carriage assembly 400 such that oppositely disposed upper and lower end portions of the outfeed idler pinch roller 438 also extend between the upper and lower members 426,428 of the wrapping or packaging film dispensing carriage assembly framework 430, while an outfeed idler target roller 440 is rotatably mounted in a similar manner upon the wrapping or packaging film dispensing carriage assembly 400 such that oppositely disposed upper and lower end portions of the outfeed idler target roller 440 likewise extend between the upper and lower wall members 426,428 of the wrapping or packaging film dispensing carriage assembly framework 430. In a manner similar to that of the infeed idler pinch and target rollers 424,432, it is seen that the outfeed idler pinch roller 438 and the outfeed idler target roller 440 are both located downstream of the first and second drive rollers 404, 406 as considered in the direction of the feeding or the dispensing of the wrapping or packaging film from the roll of wrapping or packaging film disposed upon the upstanding mandrel or spindle 402.

The upper end portion of the outfeed idler target roller 440 is also provided with a sensor target 442, which may likewise be, similar to sensor target 434, the head portion of a fastener screw threadedly engaged within the external peripheral wall portion of the outfeed idler target roller 440, and a second proximity sensor 444 is mounted upon another wall member of the wrapping or packaging film dispensing carriage assembly framework 430 so as to be capable of detecting or sensing the presence of the outfeed idler target roller sensor target 442 each time the outfeed idler target roller 440 completes one revolution. It can thus be appreciated that the film path of the wrapping or packaging film, disposed upon and dispensed from the roll of wrapping or packaging film rotatably mounted upon the upstanding spindle 402, extends from the roll of wrapping or packaging film, passes between the aforenoted first pinch roller 422 and the first target roller 432, passes between or around the first and second drive rollers 404, 406, passes around and across the external surface portion of the tension roller 408, and between the second pinch roller 438 and the second target roller 440 so as to be conducted toward the palletized load to be wrapped or packaged within the wrapping or packaging film.

Reverting back to the provision and disposition of the first and second target rollers 432,440 upon the wrapping or packaging film dispensing carriage assembly framework 430, the provision and disposition of the sensor targets 434,442 upon the first and second target rollers 434,440, and the provision and disposition of the first and second proximity sensors 436,444 upon the wrapping or packaging film dispensing carriage assembly framework 430, it is to be noted that each time the first and second proximity sensors 436,444 detect the presence of the target roller sensor targets 434, 442, indicating the rotary speeds of the target rollers 432, 440, and therefore the linear speeds of the film at the target roller locations, the first and second proximity sensors 436,444 will generate pulses which are transmitted to a first programmable logic controller (PLC) 446 mounted upon the wrapping or packaging film dispensing carriage assembly 400 as can best be seen in FIG. 5. It is to be appreciated that the rotary speeds of the first and second target rollers 432, 440, which are respectively indicative of the linear speeds of the film at the target roller locations, will be different, and that this difference in film speeds defines the amount of pre-stretch being imparted to the film as the same passes through or between the drive rollers 404,406. Signals from the tension roller 408, and more particularly, from the strain gauge or load cell incorporated therein, are also transmitted to the first programmable logic controller (PLC) 446.

The first programmable logic controller (PLC) 446 is operatively connected to a first wireless transmission module or transceiver 448, which is located adjacent to the first programmable logic controller (PLC) 446 upon the wrapping or packaging film dispensing carriage assembly 400, and it is to be appreciated that the first programmable logic controller (PLC) 446 is provided for calculating the pre-stretch level of the wrapping or packaging film, as well as the amount of the wrapping or packaging film usage, both of which are functions of the signals derived or received from the proximity sensors 436,444. In turn, such data and calculations relating, for example, to the pre-stretch of the wrapping or packaging film, or to the amount of film used for a particular wrapping or packaging operation, are transmitted by means of the first wireless transmission module or transceiver 448 to a second wireless transmission module or transceiver 450 which may be located, for example, upon a main operator console or the like 452 as illustrated within FIG. 6. The main operator console or the like 452 may contain a second programmable logic controller (PLC) 454 within which all of the aforenoted data and calculations can be stored. It is to be noted further that the main operator console or the like 452 may also be provided with one or more types of suitable human machine interfaces (HMI) 456, such as, for example, a keyboard, a keypad, numerous USB ports, a screen monitor, or the like.

In this manner, the various aforenoted data and calculations may be displayed to operator personnel for monitoring purposes, as well as for modification purposes in connection with operational parameters in order to achieve optimal performance of the wrapping or packaging system. As was noted hereinbefore, the human-machine-interface (HMI) 456, may comprise, for example, one or more USB ports such that operator personnel can effectively plug in a telephone, laptop computer, notebook, notepad, or the like, whereby all of the data stored, for example, within the second programmable logic controller (PLC) 454, can be downloaded and transmitted to remote data storage servers or the like for usage at a later time. Control commands from the operator's laptop computer, notebook, notepad, or the like, can likewise be inputted back into the second programmable logic controller (PLC) 454 for transmission back to the first programmable logic controller (PLC) 446 so as to, for example, alter the various power drive signals for the various power-driven structures of the wrapping or packaging film dispensing carriage assembly 400 so as to in fact achieve optimal output performance levels. For example, predetermined tension levels to be imparted to the wrapping/packaging film can be pre-set by operator personnel entering such tension level data into the operator console 452 for control of the drive motor 410 through means of the first and second programmable logic controllers (PLCs) 446,454. Accordingly, if the tension impressed upon the film is in fact too low or too high, as transmitted, for example, by means of the strain gauge operatively associated with the tension roller 408 to the second programmable logic controller (PLC) 454, the control of the drive motor 410 can be altered by means of suitable control signals sent to the drive motor 410 by operator personnel located at the operator console 452 and transmitted from the human machine interface (HMI) 456 and through the second programmable logic controller (PLC) 454, the second wireless transmission module or transceiver 450, the first wireless transmission module or transceiver 448, and the first programmable logic controller (PLC) 446.

In a similar manner, operator personnel can likewise monitor the amount of pre-stretch being imparted to the wrapping or packaging film, or the amount of film being used per load being wrapped or packaged. Accordingly, operator personnel can, for example, order or initiate necessary changes to be made to the use of particular ones of the first and second drive rollers 404,406, or to their operatively associated pulley drives 414,418,420, such that the relative speeds of the first and second drive rollers 404,406 is altered in accordance with optimal or desired pre-stretch parameters. Similar changes or alterations can be made if the amount of film actually being used deviates from predetermined or prescribed target values. Alternatively, based upon the various aforenoted detected data, information, values, percentages, ratios, or the like, the operator personnel may simply determine that suitable maintenance is required for the apparatus. For example, it may simply be that the wrapping or packaging film was incorrectly threaded or routed through the roller arrays upon the wrapping or packaging film dispensing carriage assembly 400. It is lastly to be appreciated, in connection with the aforenoted components comprising the film wrapping or packaging system, that the first and second wireless transmission modules 448,450 are preferably transceivers or the like in order to in fact permit two-way communication between the first and second programmable logic controllers (PLCs) 446,454. Still yet further, as has been noted, the provision of the multiple USB ports permits other auxiliary devices, such as, for example, laptop, notebook, or similar portable computers, printers, cell phones, routers, internet connect-ors, and the like, to operatively interface with the main operator console 452 whereby operator personnel can control the operative elements of the film wrapping or packaging system by means of such auxiliary devices.

Continuing still further, the system or apparatus of the present invention, comprising, for example, the wrapping or packaging film dispensing carriage assembly 400, is also provided with various other safety or operational elements or features. For example, the wrapping or packaging film dispensing carriage assembly 400 is provided with means for indicating to operator personnel that the amount of film remaining upon the roll of film, and to be dispensed in connection with a film wrapping or packaging operation, is running low and is about to run out. More particularly, as can best be appreciated from FIG. 5, the wrapping or packaging film dispensing carriage assembly 400 is provided with a photodetector or photoeye 458 which is mounted within the upper wall member 426 of the wrapping or packaging film dispensing carriage assembly 400. The photoeye 458 is located at a radial position that is slightly offset with respect to the cylindrical axis of the film roll mounting mandrel or spindle 402, upon which the existing roll of wrapping or packaging film is located, such that the line of sight of the photoeye is effectively axially aligned with an external peripheral surface portion of the film roll mounting spindle 402. In this manner, as the wrapping or packaging film, comprising the film roll disposed upon the film roll mounting spindle 402, is progressively depleted, there will come a time when the photoeye 458 will no longer detect the presence of film, coiled upon the film roll core of the roll of film, whereupon an alarm or other signal will be generated and transmitted directly to the second programmable logic controller (PLC) 454 whereby the second programmable logic controller (PLC) 454 will cause an alarm or alert message for operator personnel to hear, or to see or read upon the human machine interface (HMI) 456. The operator personnel can then, of course, shut down the apparatus or system from the operator console 452 so as to in fact permit other operator personnel to remove the depleted, or soon to be depleted, roll of wrapping or packaging film from the film roll mounting spindle 402 and to replace the same with a new or fresh roll of wrapping or packaging film such that a wrapping or packaging operation is not to be performed without an adequate supply of wrapping or packaging film present upon the wrapping or packaging film dispensing carriage assembly 400.

In connection with the aforenoted replacement of the roll of wrapping or packaging film, it is further noted that the film roll mounting spindle or mandrel 402 is normally disposed in a vertically upstanding operative position as illustrated within FIGS. 4 and 5. However, the film roll mounting spindle 402 is in fact capable of being tilted outwardly from, or with respect to, its normally disposed vertically upstanding operative position, such as, for example, through an angular movement of approximately 45°, so as to in fact facilitate the removal of the depleted roll of wrapping or packaging film from the film roll mounting spindle 402 and the mounting of a new or fresh roll of wrapping or packaging film onto the film roll mounting spindle 402.

As a safety feature incorporated into the wrapping or packaging film dispensing carriage assembly 400, a limit switch is disposed internally within a bracket housing 460 which is mounted upon the side wall member 437 of that portion of the framework 430 of the wrapping or packaging film dispensing carriage assembly 400 which effectively houses the film roll mounting mandrel or spindle 402 and the roll of wrapping or packaging film mounted thereon. In addition, as can best be appreciated from FIG. 4, the upstanding film roll mounting spindle 402 is fixedly secured upon a substantially U-shaped mounting bracket which comprises a bottom cross-piece member 464 and a pair of oppositely disposed upstanding side members 466,468. The upper end portions of the side members 466,468 are respectively pivotally secured to the side wall member 437 and an opposite side wall member 470 of the carriage assembly framework 430, as at 472,474, so as to in fact permit the upper free end portion of the upstanding film roll mounting spindle 402 to tilt outwardly and downwardly, in an arcuate manner, toward the right as viewed in FIG. 5, while, conversely, the bottom end portion of the upstanding film roll mounting spindle 402 will tilt upwardly and toward the right as viewed within FIG. 4.

As can also best be seen in FIG. 4, the lower corner portions of the substantially U-shaped mounting bracket, as defined between the bottom cross-piece member 464 and the pair of oppositely disposed upstanding side members 466, 468, are provided with corner brackets 476,478 which effectively prevent the upstanding film roll mounting spindle 402, and its substantially U-shaped mounting bracket, from overshooting its proper disposition when being rotated back from its outward pivotal or inclined film loading/unloading position to its normal operative position as a result of the corner brackets 476,478 engaging the lower end portions of the side wall members 437,470 of the framework 430 of the wrapping or packaging film dispensing carriage assembly 400. As can best be additionally appreciated from FIG. 5, the upstanding side member 466 of the U-shaped bracket is also provided with a finger 480 which engages and closes the limit switch, disposed internally within the bracket housing 460, when the upstanding film roll mounting spindle 402 has in fact been moved back to its normal upstanding operative position.

Accordingly, it can be readily appreciated that the limit switch, disposed within the bracket housing 460, is thus provided so as to effectively detect the fact that the film roll mounting spindle 402, and its substantially U-shaped mounting bracket 464,466,468, has in fact been moved back to its normally vertically upstanding operative position. If the limit switch 460 does not detect this normally vertically upstanding disposition of the film roll mounting spindle 402, it will not generate an appropriate signal to the second programmable logic controller 454 whereby the second programmable logic controller 454 will effectively prevent the apparatus or system from operating.

An additional safety feature incorporated into the wrapping or packaging film dispensing carriage assembly 400 comprises the use of a third proximity sensor 482 which is positioned, for example, upon that portion of the upper wall member 426 of the wrapping or packaging film dispensing carriage assembly 400 which effectively forms a ceiling for the section of the wrapping or packaging film dispensing carriage assembly 400 which houses the first and second drive rollers 404,406. This housing section of the wrapping or packaging film dispensing carriage assembly 400 is normally covered by means of a door, not shown, which is hingedly mounted upon the wrapping or packaging film dispensing carriage assembly 400 between OPEN and CLOSED positions. The door, not shown, is normally disposed at its CLOSED position during operational cycles so as to in cover or encase the first and second drive rollers 404,406 and thereby prevent operator personnel from being subjected to unsafe conditions by otherwise accidentally encountering the first and second drive rollers 404, 406. The door, not shown, may, however, be moved to its OPEN position during, for example, initial start-up procedures wherein the manual threading of the wrapping or packaging film along its sinusoidal flow path between the first and second drive rollers 404,406 needs to be carried out. The door, not shown, may have, for example, a locking mechanism disposed thereon which may, for example, be similar to a dead-bolt locking assembly, wherein when the door, not shown, is locked, the dead-bolt is moved to its locked position that can effectively be detected by means of the proximity sensor 482. Accordingly, if the proximity sensor 482 does not detect the fact that the door, not shown, normally covering and enclosing the first and second drive rollers 404,406, has in fact been moved to, and locked at, its CLOSED position by means of the dead-bolt member being disposed at its EXTENDED and LOCKED position, such proximity sensor 482 will emit a signal to the first programmable logic controller (PLC) 446 so as to likewise effectively prevent the film wrapping or packaging apparatus or system from initiating a film wrapping or packing operational cycle.

Thus, it may be seen that in accordance with the principles and teachings of the present invention, there has been disclosed a new and improved film dispensing and wrapping system or apparatus wherein a wrapping or packaging film dispensing carriage assembly has been provided with a pair of drive rollers which are driven at different speeds by means of a drive motor and a belt-and-pulley drive system so as to impart a predetermined amount of pre-stretch to the wrapping or packaging film. An infeed target roller and an infeed pinch roller are operatively associated with the pair of drive rollers and are provided upon the infeed side of the pair of drive rollers, while an outfeed target roller and an outfeed pinch roller are also operatively associated with the pair of drive rollers and are provided upon the outfeed side of the pair of drive rollers. Both the infeed and outfeed target rollers have sensor targets mounted thereon, and first and second proximity sensors are respectively disposed adjacent to the target rollers so as to in fact detect the presence of the sensor targets as the target rollers rotate at speeds proportional to the film speed. The film speed at the first or infeed target roller is different from the film speed at the second or outfeed target roller, and this difference in speeds comprises the amount of pre-stretch imparted to the film. The proximity sensors will generate pulse signals each time it detects one of the sensor targets each time, for example, the particular target roller completes a revolution, and these pulse signals will be transmitted to a first programmable logic controller (PLC), located upon the wrapping or packaging film dispensing carriage assembly, such that the first programmable logic controller (PLC) can then calculate the amount of pre-stretch actually being imparted to the wrapping or packaging film, as well as the amount of wrapping or packaging film actually being used for each wrapped load, or still further, for example, how many loads can in fact be wrapped or packaged using a single roll of film.

A tension roller, which has incorporated therein a suitable strain gauge or load cell, has been operatively associated with the pair of drive rollers so as to measure the tension being imparted to the wrapping or packaging film. The strain gauge or load cell will also transmit signals, indicative of the sensed tension values, to a second programmable logic controller (PLC), which is located within a remotely-located operator console, by means of first and second wireless transmission modules or transceivers such that the second programmable logic controller (PLC) can in fact calculate or determine the actual tension being imparted to the wrapping or packaging film. All of the aforenoted data signals from the target roller proximity sensors, indicative of the film speeds and the amount of film usage, and from the tension roller, indicative of the tension levels being imparted to the wrapping or packaging film, can be accessed by operator personnel by means of a human-machine interface also located upon the remotely-located operator console, and accordingly, the operator can monitor such data and make any changes to the apparatus or system components as may be deemed necessary.

Still yet further, the new and improved film dispensing and wrapping system or apparatus of the present invention has also been provided with several additional operational and safety features. For example, a photoeye is incorporated within the framework of the film dispensing and wrapping system or apparatus so as to monitor the amount of film remaining upon the roll of film mounted upon the film roll mounting spindle or mandrel. The photoeye is radially offset a predetermined amount with respect to, for example, an external peripheral portion of the mandrel or spindle, such that when the film, disposed upon the film roll, is depleted to such an extent that the diametrical extent of the film disposed upon the film roll is no longer captured by means of the photoeye, the photoeye will generate a signal indicating a low film level. This signal is transmitted directly to the second programmable logic controller (PLC), whereby, again, an operator, disposed at the operator console, can initiate the necessary operations to replace the depleted roll of wrapping or packaging film with a new or fresh roll of wrapping or packaging film. Continuing still further, the spindle or mandrel, upon which the roll of wrapping or packaging film is mounted, is pivotally movable from its normal, vertically upstanding operative position to an inclined or tilted LOAD-UNLOAD position at which the mandrel or spindle is disposed so as to facilitate the unloading of a depleted roll of film from the spindle or mandrel, and the mounting of a new or fresh roll of film onto the mandrel or spindle. Accordingly, after, for example, a new or fresh roll of film has been mounted upon the mandrel or spindle, the mandrel or spindle is pivotally moved back to its normal, vertically upstanding operative position such that the apparatus or system can now be employed to wrap or package a load within the wrapping or packaging film. The mandrel or spindle is also mounted upon a pivotal framework which includes a finger, and the finger operatively cooperates with a limit switch mounted upon the framework of the wrapping or packaging film dispensing carriage assembly so as to generate a signal when the mandrel or spindle framework has in fact been moved back to its normal, vertically upstanding operative position. This signal is transmitted directly to the second programmable logic controller (PLC). Accordingly, if such a signal is not generated by the limit switch, indicating that the mandrel or spindle has not in fact been completely moved back to its normal, vertically upstanding operative position, the second programmable logic controller (PLC) will not initiate operation of the film dispensing and wrapping system or apparatus.

It is lastly noted that another safety feature incorporated within the new and improved film dispensing and wrapping system or apparatus of the present invention resides in the provision of a third proximity sensor in conjunction with the door that is normally disposed at its CLOSED position with respect to the first and second drive rollers in order to protect operations personnel from any injuries involving the first and second drive rollers. More particularly, the door normally covering the first and second drive rollers is provided with a locking mechanism which includes, for example, a dead-bolt type locking member. Accordingly, when the locking mechanism is moved to its LOCKED position at which, for example, the dead-bolt locking member is moved to its EXTENDED position, this EXTENDED position of the dead-bolt locking member will be detected by means of this third proximity sensor. The third proximity sensor will generate a signal and transmit the same to the first programmable logic controller (PLC) which will permit operation of the film dispensing and wrapping system or apparatus to be initiated. If the first programmable logic controller (PLC) does not receive such a signal from the third proximity sensor, operation of the film dispensing and wrapping system or apparatus will be prevented.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A film wrapping/packaging apparatus, comprising:

a film dispensing carriage assembly;

a spindle mounted upon said film dispensing carriage assembly and supporting a roll of wrapping/packaging film wherein the wrapping/packaging film dispensed by said film dispensing carriage assembly from the roll of wrapping/packaging film is to be used for wrapping a load to be packaged;

first and second drive rollers driving the film from the roll of wrapping/packaging film mounted upon said spindle toward the load to be wrapped and packaged;

first and second target rollers, having sensor targets respectively mounted thereon and disposed upon opposite upstream and downstream sides of said first and second drive rollers, as considered in the direction in which the film is being dispensed from said spindle and toward the load being wrapped and packaged, respectively rotated at speeds corresponding to the speed of the film at the respective locations of said first and second target rollers;

first and second proximity sensors disposed adjacent to said first and second target rollers detecting the presence of said sensor targets respectively disposed upon said first and second target rollers each time each one of said first and second target rollers completes a revolution as the wrapping/packaging film is conducted past said first and second target rollers and generating signals indicating said detected presence of each one of said sensor targets upon each one of said first and second target rollers; and a programmable logic controller (PLC) mounted upon said film dispensing carriage assembly receiving said signals from said first and second proximity sensors and calculating the amount of pre-stretch imparted to the wrapping/packaging film as a function of the difference between the speeds of the wrapping/packaging film as the same respectively passes each one of the first and second target rollers.

2. The apparatus as set forth in claim 1, wherein:

said programmable logic controller (PLC) can calculate the amount of wrapping/packaging film being dispensed and used for a wrapping/packaging operation as a function of said signals generated by said first proximity sensor disposed adjacent to said first target roller disposed upstream of said first and second drive rollers.

3. The apparatus as set forth in claim 1, further comprising:

a tension roller disposed upon said film dispensing carriage assembly for measuring the tension imparted to the wrapping/packaging film.

4. The apparatus as set forth in claim 1, further comprising:

a photodetector mounted upon said film dispensing carriage assembly for detecting a low-film depleted condition of the wrapping/packaging film upon said spindle.

5. The apparatus as set forth in claim 1, wherein:

said spindle, upon which the roll of wrapping/packaging film is supported, is, pivotally movable between an inclined film LOAD/UNLOAD position, and a vertically upstanding operative position; and a limit switch is mounted upon said film dispensing carriage assembly for confirming the movement of said spindle back to said vertically upstanding operative position once a new/fresh roll of film has been mounted upon said spindle.

6. The apparatus as set forth in claim 1, wherein:

a door is pivotally mounted upon said film dispensing carriage assembly between an OPEN position for permitting access to said first and second drive rollers by operator personnel during inoperative periods of said film dispensing carriage assembly, and a CLOSED position for covering said first and second drive rollers so as to prevent injury to operator personnel during operative periods of said film dispensing carriage assembly; and a third proximity sensor is mounted upon said film dispensing carriage assembly for detecting the presence of a lock mechanism in order to confirm that said door is disposed at said CLOSED position.

7. The apparatus as set forth in claim 1, wherein:

said film wrapping/packaging apparatus is selected from the group comprising a turntable type film wrapping-packaging apparatus, a rotary arm type film wrapping-packaging apparatus, and a rotary ring type film wrapping-packaging apparatus.

8. The apparatus as set forth in claim 1, further comprising:

an operator console;

a second programmable logic controller (PLC) mounted upon said operator console; and a human-machine interface (HMI) mounted upon said operator console so as to permit an operator to control said first and second drive rollers from said operator console by said first and second programmable logic controllers (PLCs).

9. The apparatus as set forth in claim 8, wherein:

said human-machine interface (HMI) is selected from the group comprising one of a telephone, a keyboard, a keypad, a USB port, a laptop computer, a notebook computer, a notepad computer, and a screen monitor.

10. The apparatus as set forth in claim 9, wherein:

said human-machine interface (HMI) permits operator personnel to download data from at least one of said first and second programmable logic controllers (PLCs) for subsequent usage.

11. A method of using a film wrapping/packaging apparatus for dispensing wrapping/packaging film in order to wrap a load to be packaged within the wrapping/packaging film, comprising the steps of:

mounting a film dispensing carriage assembly upon said apparatus;

mounting a spindle upon said film dispensing carriage assembly supporting a roll of wrapping/packaging film wherein the wrapping/packaging film dispensed by said film dispensing carriage assembly from the roll of wrapping/packaging film is to be used for wrapping a load to be packaged;

mounting first and second drive rollers upon said film dispensing carriage assembly so as to drive the film from the roll of wrapping/packaging film mounted upon said spindle toward the load to be wrapped and packaged;

mounting first and second target rollers, having sensor targets respectively mounted thereon, upon opposite upstream and downstream sides of said first and second drive rollers, as considered in the direction in which the film is being dispensed from said spindle and toward the load being wrapped and packaged, so as to respectively rotate at speeds corresponding to the speed of the film at the respective locations of said first and second target rollers;

mounting first and second proximity sensors adjacent to said first and second target rollers so as to detect the presence of said sensor targets respectively disposed upon said first and second target rollers each time each one of said first and second target rollers completes a revolution as the wrapping/packaging film is conducted past said first and second target rollers and to generate signals indicating said detected presence of each one of said sensor targets upon each one of said first and second target rollers; and using a programmable logic controller (PLC) mounted upon said film dispensing carriage assembly to receive said signals from said first and second proximity sensors and to calculate the amount of pre-stretch imparted to the wrapping/packaging film as a function of the difference between the speeds of the wrapping/packaging film as the same respectively passes each one of the first and second target rollers.

12. The method as set forth in claim 11, comprising the step of:

using said programmable logic controller (PLC) to calculate the amount of wrapping/packaging film being dispensed and used for a wrapping/packaging operation as a function of said signals generated by said first proximity sensor disposed adjacent to said first target roller disposed upstream of said first and second drive rollers.

13. The method as set forth in claim 11, further comprising the step of:

using a film wrapping/packaging apparatus which is selected from the group comprising a turntable type film wrapping-packaging apparatus, a rotary arm type film wrapping-packaging apparatus, and a rotary ring type film wrapping-packaging apparatus.

14. The method as set forth in claim 11, further comprising the step of:

mounting a second programmable logic controller (PLC) upon an operator console; and using a human-machine interface (HMI), mounted upon said operator console, to permit an operator to control said first and second drive rollers from said operator console by said first and second programmable logic controllers (PLCs).

* * * * *